US010450720B2

(12) United States Patent
Van Rompay

(10) Patent No.: US 10,450,720 B2
(45) Date of Patent: Oct. 22, 2019

(54) DEVICE AND METHOD FOR REMOVING ALLUVIAL DEPOSITS FROM THE BED OF A BODY OF WATER

(71) Applicant: Boudewijn Gabriël Van Rompay, Clearwater, FL (US)

(72) Inventor: Boudewijn Gabriël Van Rompay, Clearwater, FL (US)

( * ) Notice: Subject to any disclaimer, the term of this patent is extended or adjusted under 35 U.S.C. 154(b) by 0 days.

(21) Appl. No.: 16/042,549

(22) Filed: Jul. 23, 2018

(65) Prior Publication Data

US 2018/0328000 A1 Nov. 15, 2018

Related U.S. Application Data

(63) Continuation of application No. 15/030,937, filed on Apr. 21, 2016, now Pat. No. 10,030,359.

(51) Int. Cl.
*E02F 3/88* (2006.01)
*E02F 3/90* (2006.01)
*E02F 3/92* (2006.01)

(52) U.S. Cl.
CPC ..... *E02F 3/8841* (2013.01); *E02F 3/907* (2013.01); *E02F 3/9243* (2013.01); *E02F 3/9293* (2013.01)

(58) Field of Classification Search
CPC ..... E02F 3/8841; E02F 3/907; E02F 3/9243; E02F 3/9293; A01D 46/247
See application file for complete search history.

(56) References Cited

U.S. PATENT DOCUMENTS 2,006,037 A * 6/1935 Woodruff ..... E02F 5/006 37/313
3,659,712 A * 5/1972 Chaplin ..... E02F 3/8858 210/104
4,085,781 A * 4/1978 Serpas ..... B63B 22/021 114/230.13
4,155,538 A * 5/1979 Claassen ..... B66C 13/02 212/272
5,421,105 A * 6/1995 Schulte ..... E02F 3/92 37/309
7,264,713 B2 * 9/2007 Kryzak ..... A01H 4/001 210/167.01
7,621,059 B2 * 11/2009 McCoy, Jr. ..... E02F 3/905 114/296

(Continued)

FOREIGN PATENT DOCUMENTS

BE 1018005 A3 3/2010
CA 2509695 A1 * 6/2004 ..... B05B 1/341

(Continued)

*Primary Examiner* — Robert E Pezzuto
*Assistant Examiner* — Adam J Behrens
(74) *Attorney, Agent, or Firm* — James Creighton Wray

(57) ABSTRACT

Device for removing alluvial deposits (24) from the bed (29) of a body of water, whereby the device (1) consists of a bell (2) with an open bottom (3), whereby this device (2) is provided with means to control the water level (30) in the bell (2) and with suction means to suck up alluvial deposits (24), whereby a section of the sidewall (8) of the bell (2) is open at the bottom, whereby the opening (10) can be closed by a partition (12) that can be moved between a raised and a lowered position, and that the device (1) is provided with a drive (13) to be able to drive the partition (12) into the alluvial deposits (24).

15 Claims, 2 Drawing Sheets

(56) References Cited

U.S. PATENT DOCUMENTS

| | | | | |
|---|---|---|---|---|
| 8,122,618 | B2 * | 2/2012 | Van Rompay | E02F 3/88 37/195 |
| 9,091,034 | B2 * | 7/2015 | Kryzak | A01H 4/001 |
| 9,290,241 | B2 * | 3/2016 | Kweldam | B63B 27/10 |
| 2005/0045556 | A1 * | 3/2005 | Kryzak | A01H 4/001 210/602 |
| 2009/0206041 | A1 * | 8/2009 | Van Rompay | E02F 3/88 37/317 |
| 2015/0291264 | A1 * | 10/2015 | Kryzak | A01H 4/001 210/747.5 |
| 2015/0330055 | A1 * | 11/2015 | Van Opstal | E02F 3/8841 37/333 |
| 2016/0053461 | A1 * | 2/2016 | De Keizer | G01N 15/0227 37/308 |
| 2016/0186409 | A1 * | 6/2016 | Hofstra | E02F 3/902 37/321 |
| 2016/0194851 | A1 * | 7/2016 | De Keizer | E02F 3/8841 37/333 |

FOREIGN PATENT DOCUMENTS

| | | | | | |
|---|---|---|---|---|---|
| EP | 2090699 | A2 | | 8/2009 | |
| GB | 2126627 | A | * | 3/1984 | E02F 3/30 |
| GB | 2444174 | A | * | 5/2008 | E02F 3/8841 |
| GB | 2536481 | A | * | 9/2016 | E02F 3/9262 |
| JP | S6073921 | A | | 4/1985 | |
| NL | 9301881 | A | | 6/1995 | |
| WO | WO-2009052345 | A1 | * | 4/2009 | E02F 3/905 |
| WO | WO-2010079193 | A1 | * | 7/2010 | E02F 3/8841 |
| WO | 2010143982 | A1 | | 12/2010 | |
| WO | WO-2012104314 | A1 | * | 8/2012 | E02F 3/8841 |

* cited by examiner

DEVICE AND METHOD FOR REMOVING ALLUVIAL DEPOSITS FROM THE BED OF A BODY OF WATER

This application is a continuation of application Ser. No. 15/030,937 filed Apr. 21, 2016 which claims the benefit of Belgian Application No. 2013/0746 filed Nov. 4, 2013, and PCT/BE2014/000060 filed Nov. 3, 2014, International Publication No. WO 2015/061861 A1, and the amended sheets from the IPRP, which are hereby incorporated by reference in their entirety as if fully set forth herein.

The present invention relates to a device for removing alluvial deposits from the bed of a body of water.

It is generally known that the alluvial deposits of maritime waterways or ports can be polluted with toxic chemicals and heavy metals due to accidental or illegal discharges or seepage from industrial sites, such that the removal of such polluted alluvial deposits is a difficult task.

Dredging techniques for removing alluvial deposits from the bed of a body of water using a dredger are already known.

A disadvantage is that such conventional dredging techniques are often relatively inefficient because they create a lot of turbulence such that the alluvial deposits are stirred up and the alluvial deposits are diluted such that the water content in the alluvial deposits increases.

This ensures that the volume of the alluvial deposits to be removed becomes greater, such that dredging is more time consuming and expensive.

Another disadvantage is that due to the turbulence the stirred up alluvial deposits are spread over the body of water. When polluted alluvial deposits are involved, it is possible that the polluted alluvial deposits are mixed with unpolluted alluvial deposits such that the pollution spreads undesirably.

A method is known for removing alluvial deposits in situ using a pipe that is lowered down to the potentially polluted alluvial deposits to be removed that is connected to a pump on the bank or on a vessel.

However, such a method has the disadvantage that the diameter of the pipe must be limited in order to prevent turbulence as a result of moving the pipe with all the resulting disadvantages mentioned above, such that the removal of the alluvial deposits is a time consuming and consequently expensive matter.

A direct consequence of the fact that traditional techniques for removing alluvial deposits create a lot of turbulence or cost too much is that public bodies are inclined to leave bodies of water that are known to have polluted alluvial deposits undisturbed, in order to avoid the spread of the pollution.

This means that some port zones cannot be deepened or expanded and that large zones with a potential high economic value remain unutilised.

The technique described in BE 1.018.005 is also known, whereby a bell is placed on the alluvial deposits to be removed in the body of water and is partially pushed in with its open bottom, whereby the pressure in the bell is adjusted insofar necessary in order to keep the water level in the bell as low as possible, after which the alluvial deposits in the bell can be pumped away to a discharge point. The alluvial deposits are thus removed in strips by moving the bell systematically.

This technique is very advantageous because it does not stir up the alluvial deposits during the clearance of the bed.

However, whenever the alluvial deposits are to be removed at another location, this technique requires the bell to be necessarily raised to a certain level above the alluvial deposits, to be moved to another location, and then lowered down to the alluvial deposits again.

The purpose of the present invention is to provide a solution to at least one of the aforementioned and other disadvantages.

The object of the present invention is a device for removing alluvial deposits from the bed of a body of water, whereby the device consists of a bell with an open bottom, whereby the device is provided with means to control the water level in the bell and whereby the device is provided with suction means to suck up alluvial deposits from the bell, whereby at least a section of the sidewall of the bell is open at the bottom up to a certain height, whereby the opening can be closed by a partition that can be moved between a raised position, whereby the opening is open, and a lowered position, whereby the opening is closed, and that the device is provided with a drive to be able to drive the partition into the alluvial deposits.

An important advantage with respect to the known technique with the bell is that in the case of the invention the opening in the sidewall makes it possible, when the partition is in the raised position, to move the bell over the bed without turbulence being created, or without it being necessary to raise the bell with the open bottom to above the level of the alluvial deposits.

By systematically moving the bell from a place where the alluvial deposits have been pumped away to a subsequent place where the alluvial deposits still have to be pumped away, in this way the bed can be cleared along a desired path, whereby for the movement the partition is raised each time to isolate the alluvial deposits in the bell and these alluvial deposits are then pumped or sucked away, and the partition is then raised and the bell is moved to a subsequent position.

Consequently the device enables alluvial deposits to be removed more quickly whereby the bell will then move along strip-shaped movements over the bed of the body of water.

An advantage is that such a device will not stir up or cause any turbulence in the alluvial deposits because the bell isolates the alluvial deposits such that any polluted alluvial deposits are not spread over a larger area and such that the alluvial deposits are not diluted.

By keeping the water level in the bell as low as possible during the pumping or suction, a maximum of a small quantity of water that is still above the alluvial deposits will be sucked with it by the suction means.

Another advantage is that during pumping there is no risk that alluvial deposits will move under the open bottom to the outside. On the contrary, the suction means will suck any alluvial deposits from outside the bell under the open bottom.

The invention also concerns a method for removing alluvial deposits from the bed of a body of water, making use of a bell with an open bottom and a sidewall with an opening that can be closed by a partition, characterised in that the method comprises the following steps:

- driving the bell into the alluvial deposits over a depth corresponding to the thickness of the alluvial deposits to be removed;
- controlling the pressure in a bell so that the water level in the bell is kept as low as possible during the next steps;
- the pumping or suction of the alluvial deposits out of the bell;
- the opening of the opening by raising the partition;
- the moving of the bell in the alluvial deposits with the open opening in the movement direction over a distance that is practically equal to the length of the bell in order to suck up a subsequent quantity of alluvial deposits;

the closing of the sidewall by lowering the partition and isolating the next quantity of alluvial deposits in the bell;

the cyclical repetition of the last four steps until all the alluvial deposits to be removed from the bed have been removed along a desired path.

A device and method for removing alluvial deposits on the bed of a body of water according to the invention can not only be used for removing polluted alluvial deposits, but can also be used for dredging rivers, ports and similar in order to safeguard the depth of the rivers, ports and similar.

Indeed, the device and method according to the invention will enable the unevenness of the bed of the body of water formed by the alluvial deposits to be eliminated to a few centimeters accuracy.

Because the spread of alluvial deposits can be limited, the invention can also be used for underwater mining for example.

With the intention of better showing the characteristics of the invention, a few preferred variants of a device according to the invention and a method thereby applied are described hereinafter by way of an example, without any limiting nature, with reference to the accompanying drawings, wherein:

DETAILED DESCRIPTION

Figure 1:
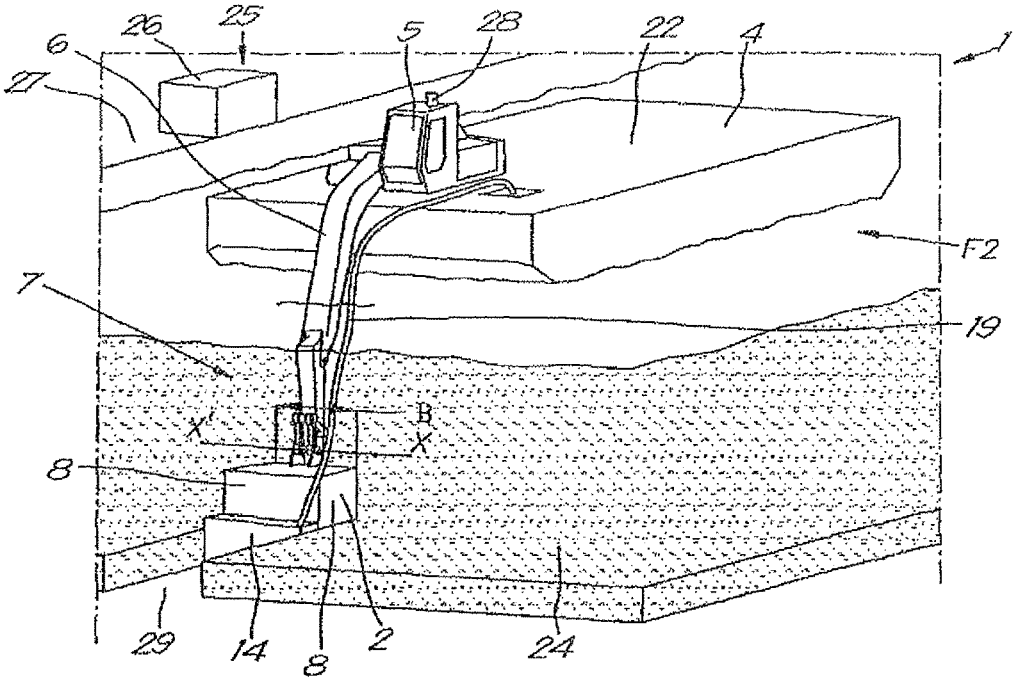
FIG. 1 schematically shows a perspective view of a device according to the invention.
Figure 2:
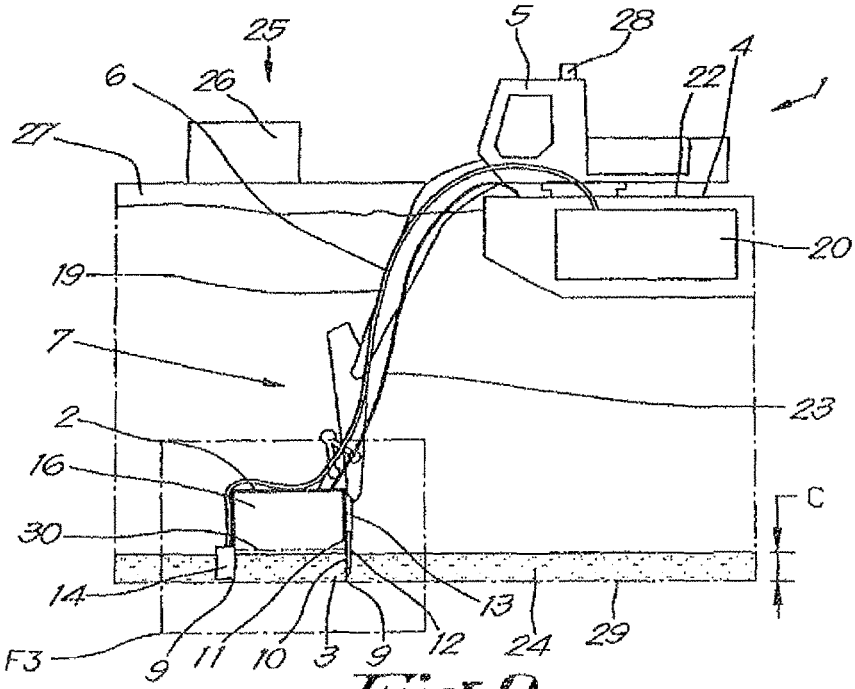
FIG. 2 shows a side view of the device of FIG. 1.
Figure 3:
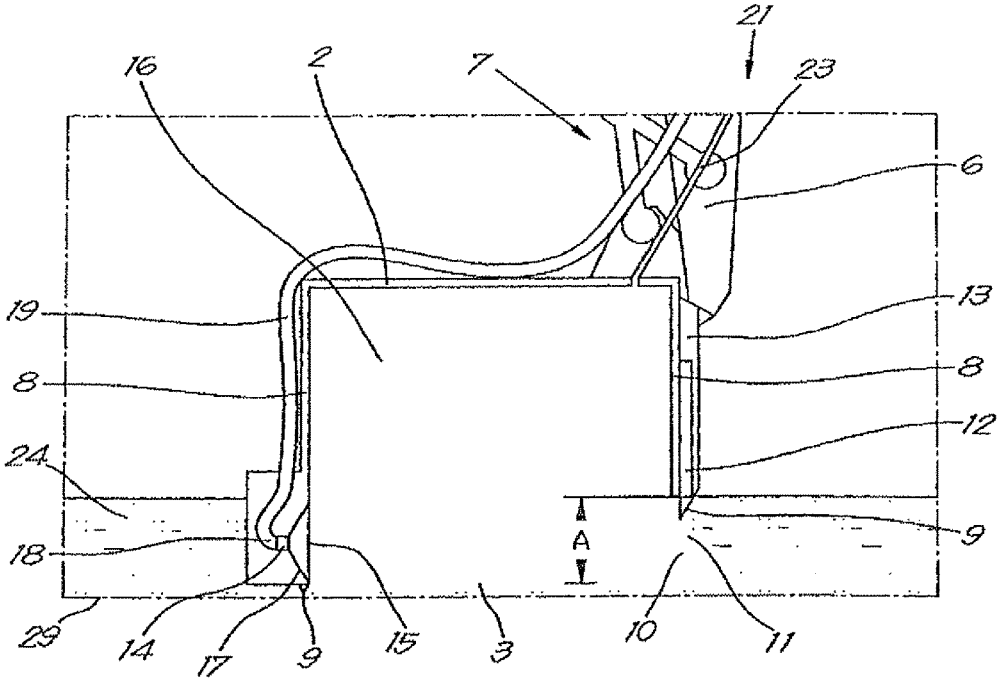
FIG. 3 shows a cross-section of the section indicated by F3 in FIG. 2.

The device 1 shown in FIGS. 1 to 3 essentially comprises a bell 2 with an open bottom 3, a floating structure 4 with a hydraulic crane 5 affixed thereon.

The device 1 is placed in a body of water, for example in a port.

In this case the floating structure 4 is constructed as a pontoon, but it is not excluded that a vessel, ship or similar is used.

The hydraulic crane 5 has an articulated arm 6 to which the bell 2 is fastened in a hingeable way by means of an axis X-X', and which is provided with a hydraulic circuit 7 to be able to move the articulated arm 6 and to make it pivot around the aforementioned axis X-X'.

The bell 2 is constructed as a rectangular chamber with four sidewalls 8 and an open bottom 3 whereby the bottom edges 9 of the sidewalls 8 of the bell 2 are constructed as a blade.

A sidewall 8 of the bell 2 is provided with an opening 10, whereby this opening 10 extends from the open bottom 3 up to a certain height A and over the entire width B of the bell 2. The edges 11 of this opening 10 are also constructed as a blade.

A partition 12 is provided that can move between a raised position whereby the opening 10 in the sidewall 8 is open, as shown in FIG. 3, and a lowered position whereby the opening 10 is closed by the partition 12, as shown in FIG. 2.

The partition 12 is provided with a drive 13, in this case in the form of hydraulic cylinders that are operated from the hydraulic crane 5 in order to be able to move the partition 12.

Furthermore, suction means are provided in the form of a pump 14 that is provided on the outside of a sidewall 8 of the bell 2, whereby the suction opening 15 is coupled to the internal space 16 of the bell using a suction funnel 17 that is at the level of the opening 10 in the sidewall 8.

The outlet 18 of the pump 14 is coupled to a pipe 19, which in this case leads to a discharge point 20 via the articulated arm 6 of the hydraulic crane 2, whereby in this case the discharge point 20 is provided in the floating structure 4 of the pontoon.

The device 1 is also provided with a compressed air installation 21 to be able to control the pressure in the bell 2, whereby for example a compressor is provided on the deck 22 of the pontoon that is connected to the internal space 16 of the bell 2 via compressed air pipes 23.

Furthermore, the device is provided with means to determine the position of the bell 2 and a computer-controlled controller, not shown in the drawings, coupled thereto for removing alluvial deposits 24.

In this case the means for determining the position of the bell 2 consist of a laser installation 25 whose transmitter is affixed on the quay 27 and whose receiver 28 is provided on the crane 5, whereby the signal from the laser installation 25 is coupled to the computer-controlled controller, which in this case is on the floating structure 4, whereby the position and orientation of the crane 5 can be determined, and due to the combination of these data with the data from sensors that determine the position of the bell 2 with respect to the pontoon, the absolute position of the bell 2 can be determined at any time.

The operation of the device 1 is very simple and as follows.

Using the floating structure 4 the hydraulic crane 5 and the bell 2 are brought to a desired location in the port or the river, for example by the pontoon being provided with its own drive.

The computer-controlled controller will control the drive of the pontoon and hydraulic crane 5 such that the bell 2 can be lowered to the bed 29 at the desired position.

The hydraulic crane 5 will drive the bell 2 with its bottom edge 9 in the alluvial deposits 24 to a depth C that is equal to the thickness C of the alluvial deposits 24 to be removed, as shown in FIG. 2, whereby it is preferably ensured that at that time the partition 12 is approximately at the level of the top layer of the alluvial deposits 24. The blade at the bottom edges 9 of the bell 2 will as it were cut through the alluvial deposits 24.

The hydraulic crane 5 will ensure that the bell 2 is kept at the right depth underwater against the upward force of the air that is enclosed in the bell 2.

Then the partition 12 is pushed downwards to penetrate into the alluvial deposits 24 and thus to isolate a quantity of alluvial deposits 24 in the space 16 of the bell 2, after which, by means of the compressed air installation 21, the pressure in the bell 2 is adjusted so that the level 30 of the water in the bell 2 is kept as low as possible with a minimum quantity of water above the alluvial deposits 24 in the bell 2.

Then the pump 14 is brought into operation in order to pump or suck the alluvial deposits 24 from the bell 2 and to transport them via the pipe 19 to the discharge point 20.

The alluvial deposits 24 can be removed efficiently through the use of the suction funnel 17 and because the suction opening 15 of the pump 14 is at the level of the opening 10 in the sidewall 8, in other words at the level of the alluvial deposits 24.

Moreover, no turbulence will be caused in the alluvial deposits 24 as the bell 2 isolates the alluvial deposits 24 that are removed by the pump 14, and the pump 14 will prevent the spread of the alluvial deposits 24 from the bell 2 to the outside.

By selecting a pump 14 with a sufficient capacity, the pumping of the alluvial deposits 24 in the bell 2 can be completed in a few seconds, also due to the fact that the volume to be pumped away is essentially limited to the volume of the alluvial deposits 24 isolated in the internal space 16 of the bell 2 with a minimum of water.

When the alluvial deposits 24 are removed from the bell 2, the partition 12 is moved upwards by the hydraulics 7 of the crane 5 using the hydraulic cylinders.

The opening 10 will hereby be opened up to or approximately up to the level of the alluvial deposits 24, as shown in FIG. 3.

Then the computer-controlled controller will ensure that the bell 2 is moved in a horizontal direction without thereby raising the bell 2.

The bell 2 is thereby moved such that the opening 10 is oriented towards the alluvial deposits 24 still to be removed, whereby when the bell 2 is moved the edges 11 of the opening 10 cut through the alluvial deposits 24 and the bell 2 is thus moved to a position on the path that has been mapped out in order to remove the alluvial deposits 24.

When the sidewall 8 opposite the opening 10 comes into contact with the alluvial deposits 24 still to be removed, in other words when the alluvial deposits 24 completely occupy the open bottom of the bell 2, the partition 12 is again lowered to isolate a new quantity of alluvial deposits 24 in the internal space 16 of the bell 2 and these are then pumped away analogously to the first step.

By raising the partition 12 and due to the blades present on the edge 11 of the opening 10, the moving of the bell 2 over the bed 29 is coupled with no or only very minimal turbulence of the alluvial deposits 24.

The successive movements of the bell 2 will be done systematically along a specified path, in this case by means of the computer-controlled controller that controls the floating structure 4 and the hydraulic crane 5 on the basis of the signal from the laser installation 25. In other words it is possible to map out an area to be cleared beforehand and to determine a path with successive tracks for the bell 2, whereby this path can be preprogrammed in the controller, after which the controller can control the device 1 autonomously.

It is not excluded that the device 1 is provided with more than one pump 14.

It is not excluded either that the pump 14 is fastened to the partition 12.

It is not excluded either that instead of a pump 14, one or more pistons are used for sucking the alluvial deposits 24 away.

Figure 4:
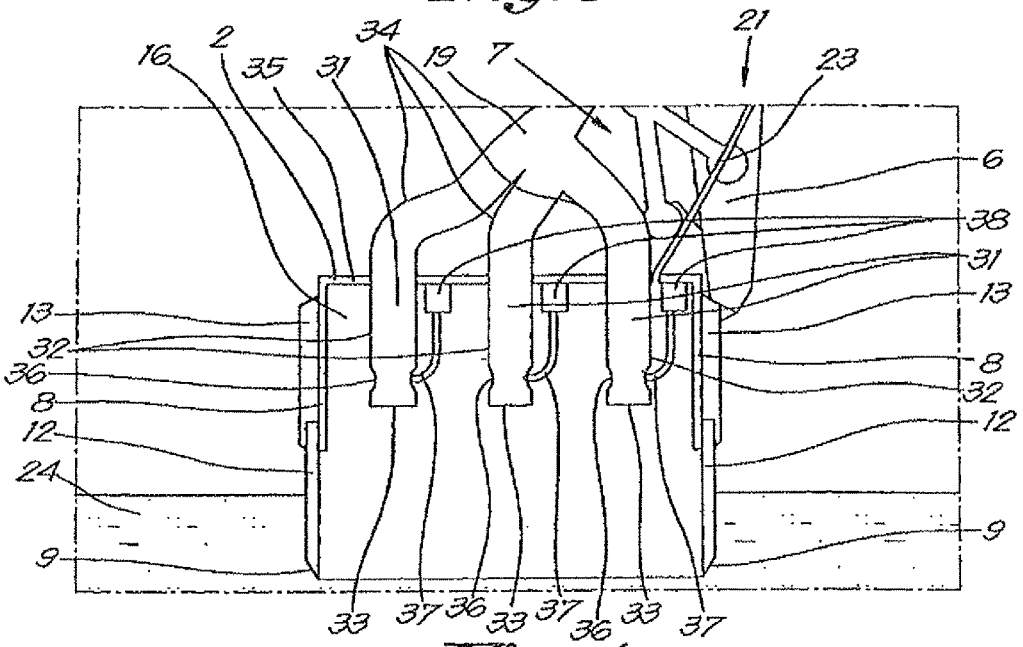
FIG. 4 shows an alternative embodiment of the device of FIG. 3.

FIG. 4 shows an alternative embodiment of a device 1 according to the invention. This embodiment differs from the previous embodiment by there being two openings 10 located opposite one another at the bottom in the sidewall 8 of the bell 2. Each of these openings 10 can be closed by means of a partition 12 with a drive 13, analogous to the opening 10 of the previous embodiment.

Furthermore, in this embodiment there is no pump 14 on the outside of a sidewall 8. Three gas lift pumps 31 are provided. Each gas lift pump 31 consists of a tube 32 that extends through an airtight sealed opening in the top 35 of the bell 2, with the suction inlet 33 up to the inside 16 of the bell 2 and of which the other end 34 is coupled to the pipe 19.

The tubes 32 can be moved vertically up to the level of the open bottom 3 of the bell 2.

The tubes 32 are provided with a constriction or venturi 36, which in this case is at the end 33 of the tube 32. At the level of this venturi 36 there is a supply 37 of pressurised gas, such as compressed air, whereby in this case the supply 37 is coupled to a compressor 38.

It is not excluded that the supply 37 is coupled to the compressed air pipes 23 by means of a branch thereof.

It is not excluded that the tubes 32 are provided with a number of successive constrictions or venturis 36.

The advantage of such gas lift pumps 31 is that there are no moving parts, such that gas lift pumps 31 are suitable for polluted alluvial deposits 24.

The operation of the device 1 is analogous to the operation of the embodiment described above.

In this case to remove the alluvial deposits 24 that are in the bell 2, use is made of the gas lift pumps 31.

The tubes 32 are lowered into the alluvial deposits 24 after which compressed air is brought into the tubes via the supply 37.

Under the influence of the gas lift effect and the venturi effect as a result of the constriction 36, the compressed air will carry the alluvial deposits 24 upwards in the tube 32, after which they can be transported to the discharge point 20 via the pipe 19.

When the alluvial deposits 24 are removed from the bell 2, the tubes 32 are moved upwards again, as shown in FIG. 4 and both partitions 12 are moved upwards by the hydraulics 7 of the crane 5 using the hydraulic cylinders in order to open both openings 10.

Then the bell 2 is moved in a horizontal direction without thereby raising the bell 2.

Because there are two openings 10 in the sidewall located opposite one another, boulders or similar that are in the bell 2 and which have not been sucked away by the gas lift pump 31 do not cause an obstacle when moving the bell 2.

When the alluvial deposits 24 completely occupy the open bottom 3 of the bell 2, the partitions 12 are lowered again in order to isolate a subsequent quantity of alluvial deposits 24 in the internal space 16 of the bell 2, and then to suck them away analogously to that described above.

It is not excluded that in the embodiment of FIG. 3 use is made of one or more gas lift pumps 31.

It is not excluded either that in the embodiment of FIG. 3 the bell 2 is provided with two openings 10, whereby the pump 14 is fastened to a partition 12.

In all examples shown above it is not excluded that the floating structure 4 is constructed as a ship, whereby it can move to subsequent zones where there are alluvial deposits 24 to be removed.

It is clear that a controller can be provided to adjust the height A of the opening as a function of the thickness C of the alluvial deposits 24 to be removed.

It is clear that the means for implementing the position of the bell do not necessarily comprise a laser installation 25, but for example can also be implemented on the basis of a GPS installation.

The present invention is by no means limited to the embodiment described as an example and shown in the drawings, but such a method and device can be realised in different variants without departing from the scope of the invention.

The invention claimed is:

1. Device (1) for removing alluvial deposits (24) from a bed (29) of a body of water comprising a bell (2) with an open bottom (3) and a compressor to control a water level (30) in the bell (2), a pump to suck up the alluvial deposits (24) from the bell (2), at least a section of a first sidewall (8) of the bell (2) having a first opening (10) at the bottom up to a specified height (A), a partition (12) for closing the first opening (10), the partition (12) movable between a raised position for opening the first opening (10) and a lowered position for closing the first opening (10), a drive (13) operable from a hydraulic crane (5) affixed to a floating structure with an articulated arm (6) having an end fastened to the bell (2), and a computer-controlled controller coupled to the drive (13) for moving the partition (12) and for moving the bell (2) in a horizontal direction without raising the bell (2).

2. Device according to claim 1, wherein the bell (2) is constructed as a rectangular chamber with four sidewalls (8) comprising bottom edges constructed as a blade, and wherein edges (11) of the opening (10) are also constructed as a blade.

3. Device according to claim 1, wherein the compressor for controlling the water level (30) in the bell (2) are formed by a compressed air installation (21) for controlling pressure in the bell (2).

4. Device according to claim 3, further comprising a crane drive to-drive the open bottom (3) of the bell (2) into the alluvial deposits (24) to a depth (C) that is equal to a thickness of the alluvial deposits (24) to be removed.

5. Device according to claim 4, wherein the drive (13) for moving the partition (12) onto the alluvial deposits (24) is formed by hydraulic cylinders operable from the hydraulic crane (5).

6. Device according to claim 5, wherein the pump is movable to a level of the opening (10) in the sidewall (8) or up to a level of the open bottom (3) of the bell (2).

7. Device according to claim 6, wherein the pump is formed by a gas lift pump (31), consisting of a tube (32) that extends through an airtight sealed opening in a wall of the bell (2) to an inside space (16) of the bell (2), whereby air is blown in the tube (32) at a location of a suction inlet or in the vicinity thereof.

8. Device according to claim 7, further comprising a venturi in the tube (32), wherein air is blown in the tube (32) at the location of the venturi.

9. Device according to claim 1, wherein the bell (2) further comprises a second opening (10) at the bottom in a second sidewall (8) opposite the first sidewall (8) with the first opening (10), wherein the second opening is closable with the partition (12).

10. Device according to claim 1, wherein the pump is provided with or connected to an outlet (18) and/or pipe (19) for transport of the sucked-up alluvial deposits (24) to a discharge point (20).

11. Device according to claim 1, wherein the computer controlled controller systematically moves the bell (2) along a specified path.

12. Device according to claim 1, further comprising sensors for determining position of the bell (2).

13. Device according to claim 1, wherein at a start of a removal process the computer-controlled controller for the removal of alluvial deposits (24) systematically moves the bell (2) along a specified path thereby driving the bell (2) into the alluvial deposits (24), and the alluvial deposits (24) are pumped or sucked out of the bell (2) after isolating a space (16) in the bell (2) by moving the partition (12) down onto the alluvial deposits (24), and then each time, after raising the partition (12), by moving the bell (2) with the first opening (10) in a movement direction to a subsequent position, closing the first opening (10) again by lowering the partition (12) again, and pumping or sucking away the alluvial deposits (24) in the bell (2) in order to, after raising the partition (12) again, systematically move the bell (2) further.

14. Device according to claim 1, wherein the first opening (10) extends over a width (B) of the bell (2).

15. Device according to claim 10, wherein the discharge point (20) is provided on a floating structure (4) selected from a vessel, ship, or similar floating structure.

* * * * *